US007290874B2

(12) United States Patent
Codos

(10) Patent No.: US 7,290,874 B2
(45) Date of Patent: Nov. 6, 2007

(54) METHOD AND APPARATUS FOR INK JET PRINTING ON RIGID PANELS

(75) Inventor: Richard N. Codos, Warren, NJ (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/827,097

(22) Filed: Apr. 19, 2004

(65) Prior Publication Data

US 2005/0024459 A1 Feb. 3, 2005

Related U.S. Application Data

(63) Continuation of application No. 09/989,006, filed on Nov. 21, 2001, now Pat. No. 6,755,518, which is a continuation-in-part of application No. PCT/US01/27023, filed on Aug. 30, 2001.

(51) Int. Cl.
*B41J 2/01* (2006.01)

(52) U.S. Cl. ..... 347/102; 347/103

(58) Field of Classification Search ..... 347/102, 347/8, 4, 105, 101, 103; 250/504; 345/101
See application file for complete search history.

(56) References Cited

U.S. PATENT DOCUMENTS 3,686,940 A 8/1972 Kockott (Continued)

FOREIGN PATENT DOCUMENTS

DE 3902643 1/1989

(Continued)

OTHER PUBLICATIONS

Hars, C., *Better Drying with Cold Ultraviolet Irradiation?*, Polygraph, V. 43, No. 6, Mar. 20, 1990, pp. 518-519 (German and English Translation).

(Continued)

*Primary Examiner*—Stephen Meier
*Assistant Examiner*—Ly T. Tran
(74) *Attorney, Agent, or Firm*—Michael Best & Friedrich LLP

(57) ABSTRACT

Ink jet printing is provided onto rigid panels such as foamboard and contoured material using ultraviolet (UV) light curable ink, which is first at least partially cured with UV light and then may be subjected to heating. Printhead-to-panel spacing is controllable to maintain a predetermined constant distance from the printing element to the surface of the panel where the ink is to be applied. Each of a plurality of printheads may be independently moveable to control the spacing of the printheads from the substrate surface. Sensors on the printhead carriage measure the shape, or vertical position of, the printhead's distance from the printhead carriage to the surface of the substrate being printed. The position or focal length of the UV light curing head may be varied to maintain focus of the UV light on the ink on a contoured surface of the substrate. UV curing heads may be located on the printhead carriage, one on each side of the printheads, and activated alternately as the carriage reciprocates, to spot cure and freeze the dots of ink immediately after being deposited on the substrate. Cold UV sources may be used to prevent heat deformation of flat or contoured substrates during printing, thereby making spot curing on heat-sensitive substrates such as foamboard possible.

21 Claims, 3 Drawing Sheets

U.S. PATENT DOCUMENTS

| | | | | |
|---|---|---|---|---|
| 3,733,709 | A | 5/1973 | Bassemr et al. | |
| 4,005,135 | A | 1/1977 | Helding | |
| 4,015,340 | A | 4/1977 | Treleven | |
| 4,048,490 | A | 9/1977 | Troue | |
| 4,048,917 | A | 9/1977 | Skrypek et al. | |
| 4,101,424 | A | 7/1978 | Schooley et al. | |
| 4,135,098 | A | 1/1979 | Troue | |
| 4,218,831 | A | 8/1980 | Harris et al. | |
| 4,222,177 | A | 9/1980 | Mason | |
| 4,271,347 | A | 6/1981 | Svenson | |
| 4,340,893 | A * | 7/1982 | Ort | 347/102 |
| 4,408,400 | A | 10/1983 | Colapinto | |
| 4,563,589 | A | 1/1986 | Scheffer | |
| 4,592,276 | A | 6/1986 | Dubuit | |
| 4,619,050 | A | 10/1986 | Klemm | |
| 4,644,899 | A | 2/1987 | Glaus | |
| 4,712,119 | A | 12/1987 | Kiyohara | |
| 4,798,960 | A | 1/1989 | Keller et al. | |
| 4,836,102 | A | 6/1989 | Cicci | |
| 4,841,306 | A | 6/1989 | Archer et al. | |
| 4,864,145 | A | 9/1989 | Burgio, Jr. | |
| 4,914,522 | A | 4/1990 | Duffield et al. | |
| 4,983,852 | A | 1/1991 | Burgio, Jr. | |
| 4,989,343 | A | 2/1991 | Ericsson | |
| 4,994,705 | A | 2/1991 | Linder et al. | |
| 5,041,846 | A | 8/1991 | Vincent et al. | |
| 5,147,130 | A | 9/1992 | Watanuki | |
| 5,192,141 | A | 3/1993 | Chung et al. | |
| 5,343,629 | A | 9/1994 | Rae | |
| 5,398,049 | A | 3/1995 | Terasawa et al. | |
| 5,440,137 | A | 8/1995 | Sowers | |
| 5,448,276 | A | 9/1995 | Hirabayashi et al. | |
| 5,455,607 | A | 10/1995 | Rhoads et al. | |
| 5,502,310 | A | 3/1996 | Niestrath et al. | |
| 5,667,850 | A | 9/1997 | Gaven et al. | |
| 5,705,822 | A | 1/1998 | Su | |
| 5,722,761 | A | 3/1998 | Knight | |
| 5,757,389 | A | 5/1998 | Schwede et al. | |
| 5,774,155 | A | 6/1998 | Medin et al. | |
| 5,864,352 | A * | 1/1999 | Aoki et al. | 347/102 |
| 5,873,315 | A | 2/1999 | Codos | |
| 5,896,154 | A * | 4/1999 | Mitani et al. | 347/102 |
| 5,932,886 | A | 8/1999 | Arai et al. | |
| 6,035,548 | A | 3/2000 | Rae | |
| 6,081,181 | A | 6/2000 | Kawase et al. | |
| 6,092,890 | A * | 7/2000 | Wen et al. | 347/101 |
| 6,118,130 | A | 9/2000 | Barry | |
| 6,120,199 | A | 9/2000 | Takekoshi | |
| 6,124,600 | A | 9/2000 | Moroishi et al. | |
| 6,145,979 | A | 11/2000 | Caiger et al. | |
| 6,168,269 | B1 | 1/2001 | Rasmussen et al. | |
| 6,185,840 | B1 | 2/2001 | Noelle et al. | |
| 6,283,651 | B1 | 9/2001 | Holmberg | |
| 6,312,123 | B1 * | 11/2001 | Codos et al. | 347/102 |
| 6,315,468 | B2 | 11/2001 | Kishida et al. | |
| 6,322,208 | B1 | 11/2001 | Bugner et al. | |
| 6,354,015 | B1 | 3/2002 | Ogasawara et al. | |
| 6,401,608 | B1 | 6/2002 | Lyon et al. | |
| 6,425,663 | B1 | 7/2002 | Eastlund et al. | |
| 6,444,964 | B1 | 9/2002 | Eastlund et al. | |
| 6,457,823 | B1 * | 10/2002 | Cleary et al. | 347/102 |
| 6,508,550 | B1 | 1/2003 | Eastlund et al. | |
| 6,550,906 | B2 | 4/2003 | Ylitalo | |
| 6,562,413 | B1 | 5/2003 | Morgavi | |
| 6,571,711 | B1 | 6/2003 | Bostrack | |
| 6,575,093 | B1 | 6/2003 | Principe | |
| 6,599,585 | B2 | 7/2003 | Blacker, Jr. et al. | |
| 6,616,355 | B2 | 9/2003 | Cleary et al. | |
| 6,621,087 | B1 | 9/2003 | Bisges et al. | |
| 6,637,958 | B2 | 10/2003 | Smith | |
| 6,679,640 | B2 | 1/2004 | Smith | |
| 6,755,518 | B2 * | 6/2004 | Codos | 347/102 |
| 6,786,578 | B1 | 9/2004 | Aschman et al. | |
| 6,834,948 | B2 | 12/2004 | Asano et al. | |
| 6,857,803 | B2 | 2/2005 | Smith | |
| 6,874,860 | B2 | 4/2005 | Lahut et al. | |
| 6,905,189 | B1 | 6/2005 | Duffield | |
| 2001/0020959 | A1 | 9/2001 | Van Soest et al. | |
| 2002/0149660 | A1 | 10/2002 | Cleary et al. | |

FOREIGN PATENT DOCUMENTS

| | | |
|---|---|---|
| EP | 1108553 | 6/2001 |
| GB | 2258296 | 2/1993 |
| JP | 57129770 | 8/1982 |
| JP | 61164836 | 7/1986 |
| JP | 63-62738 | 9/1986 |
| JP | 63062738 | 3/1988 |
| JP | 02283452 | 11/1990 |
| JP | 4039076 | 2/1992 |
| JP | 4110153 | 4/1992 |
| JP | 4163176 | 6/1992 |
| JP | 08267796 | 10/1996 |
| JP | 2000185418 | 7/2000 |
| JP | 2001310454 | 11/2001 |
| JP | 2002137375 | 5/2002 |
| JP | 2002144553 | 5/2002 |
| JP | 2002144555 | 5/2002 |
| JP | 2002292907 | 10/2002 |
| WO | WO 9704964 | 2/1997 |
| WO | WO 0117780 | 3/2001 |

OTHER PUBLICATIONS

Klamann, P., *Dichroic Reflectors for UV Installations*, Coating, V. 30, No. 8, Aug. 1997, pp. 293-296.

Aspinall, T., *Using Cold UV Curling to Find New Benefits*, 4th International Flexographic Printing Conference, Manchester, UK, Sep. 1999, 12 pp.

Jackson, P., *New Cold-Cure High-Performance UV Systems*, ink Pritn Int., V. 12, No. 3, 1994 pp. 8-9.

Hayes, R., *Cold UV Takes the Heat Out of Curing*, Printing World, V. 266, No. 9, May 31, 1999. p. 22.

Anon., *Taming UV Temperature*, Converting Today, V. 11, No. 11, Dec. 1997, p. 19.

Anon., *Turning the Heat Off: Cold Curing in Flexography*, Polymers Paint Colour Journal, V. 186, No. 4383, Aug. 1996, p. S1.

Anon, *Cold UV Ltd Launch Truly Cold Excimer UV Curing Systems*, Screen Process, V. 48, No. 9, Sep. 1998, p. 57.

O'Leary, Sean, *Flatbed Printers Don't Rest on a Roller*, Graficos de Hoy website, Aug. 8, 2001 (Spanish and English Translation).

Stephanie Duschene; One-of-a-Kind Web Raises the Stakes; Graphics Arts Monthly; Jan. 1999; pp. S10-S13.

New Products; Graphic Arts Monthly; Jul. 1999; pp. 1-3; vol. 71, Issue 7.

R.H. Leach and R.J. Pierce; The Printing Ink Manual; Fifth Edition 1993; p.1 (and 1 page Library of Congress Onlline Catalog).

Stephanie Haugan; Foreging Into The Next Frountier: Package Printing; Graphic Arts Monthly; Jun. 2000; pp. 1-4; vol. 72, Issue 6.

Debora Toth; New Cures For The Common Coat; Graphic Arts Monthly; Mar. 2001; pp. 1-6; vol. 73, Issue 3.

Jim Rosenberg; The Promise of CTP; Editor & Publisher (GEDP); Sep. 17, 2001; pp. T4-T12; vol. 134 No. 36.

Stewart Partridge; Innovations in Output—Flatbed Inkjet Presses& UV-Urable Inks; IMI 10th InkJet Conference, Scottsdale, US; Apr. 24, 2001; pp. 1-15.

Edmund Optics; Miniature Ultraviolet Quartz Pencil Lamps; http://www.edmundoptics.com/onlinecatalog/displayproduct.cfm?productID=1466.

United States District Court Eastern District of Missouri Eastern Division; Memorandum and Order; *Leggett & Platt, Inc.* v. *Vutek, Inc.*, Case No. 4:05 CV 788 CDP; United States District Court Eastern District of Missouri, Eastern Division; May 25, 2006.

Daniel J. Whittle, Ph.D.; Expert Report of Daniel J. Whittle, Ph.D. Regarding Prior Art to U.S. Patent 6,755,518; *Leggett & Platt, Inc.* v. *Vutek, Inc.*, Case No. 4:05 CV 788; United States District Court Eastern District of Missouri, Eastern Division; Jun. 7, 2006.

Dalbert U. Shefte; Preliminary Expert Report of Dalbert U. Shefte; *Leggett & Platt, Inc.* v. *Vutek, Inc.*, Case No. 4:05 CV 788; United States District Court Eastern District of Missouri, Eastern Division; Jun. 8, 2006.

David R. Spencer; Expert Report of David R. Spencer; *Leggett & Platt, Inc.* v. *Vutek, Inc.*, Case No. 4:05 CV 788; United States District Court Eastern District of Missouri, Eastern Division; Jun. 9, 2006.

Frank Romano; Expert Report of Frank Romano; *Leggett & Platt, Inc.* v. *Vutek, Inc.*, Case No. 4:05 CV 788; United States District Court Eastern District of Missouri, Eastern Division; May 31, 2006.

Frank Romano; Supplemental Expert Report of Frank Romano; *Leggett & Platt, Inc.* v. *Vutek, Inc.*, Case No. 4:05 CV 788; United States District Court Eastern District of Missouri, Eastern Division; Jun. 9, 2006.

Frank Romano; Supplemental Expert Report of Frank Romano; *Leggett & Platt, Inc.* v. *Vutek, Inc.*, Case No. 4:05 CV 788; United States District Court Eastern District of Missouri, Eastern Division; Jun. 9, 2006.

Roger D. McWilliams; Technical Expert Report of Roger D. McWilliams; *Leggett & Platt, Inc.* v. *Vutek, Inc.*, Case No. 4:05 CV 788; United States District Court Eastern District of Missouri, Eastern Division; Jun. 9, 2006.

Roger McWilliams; Rebuttal Expert Report of Roger McWilliams; *Leggett & Platt, Inc.* v. *Vutek, Inc.*, Case No. 4:05 CV 788; United States District Court Eastern District of Missouri, Eastern Division; Jul. 25, 2006.

Donald S. Feagan; Rebuttal Expert Report of Donald S. Feagan; *Leggett & Platt, Inc.* v. *Vutek, Inc.*; Case No. 4:05 CV 788; United States District Court Eastern District of Missouri, Eastern Division; Aug. 2, 2006.

Daniel J. Whittle, Ph.D.; Rebuttal Expert Report of Daniel J. Whittle, Ph.D. Regarding U.S. Patent 6,755,518; *Leggett & Platt, Inc.* v. *Vutek, Inc.*; Case No. 4:05 CV 788; United States District Court Eastern District of Missouri, Eastern Division; Aug. 7, 2006.

Gerald J. Mossinghoff; Rebuttal Expert Report of the Honorable Gerald J. Mossinghoff; *Leggett & Platt, Inc.* v. *Vutek, Inc.*; Case No. 4:05 CV 788; United States District Court Eastern District of Missouri, Eastern Division; Aug. 7, 2006.

Dalbert U. Shefte; Rebuttal Expert Report of Dalbert U. Shefte; *Leggett & Platt, Inc.* v. *Vutek, Inc.*; Case No. 4:05 CV 788; United States District Court Eastern District of Missouri, Eastern Division; Aug. 8, 2006.

David R. Spencer; Rebuttal Expert Report of David r. Spencer; *Leggett & Platt, Inc.* v. *Vutek, Inc.*; Case No. 4:05 CV 788; United States District Court Eastern District of Missouri, Eastern Division; Aug. 10, 2006.

Frank Romano; Rebuttal Expert Report of Frank Romano; *Leggett & Platt, Inc.* v. *Vutek, Inc.*; Case No. 4:05 CV 788; United States District Court Eastern District of Missouri, Eastern Division; Aug. 10, 2006.

United States District Court Eastern District of Missouri Eastern Division; Vutek's Motion for Summary Judgment of Invalidity of Claims 1-3, 7, 9-10, and 19 of U.S. Patent No. 6,755,518; *Leggett & Platt, Inc.* v. *Vutek, Inc.*, Case No. 4:05 CV 788 CDP; United States District Court Eastern District of Missouri, Eastern Division; Oct. 2, 2006.

United States District Court Eastern District of Missouri Eastern Division; Vutek's Statement of Material Facts as to Which There Can Be No Genuine Dispute in Support of Vutek's Motion for Summary Judgment of Invalidity; *Leggett & Platt, Inc.* v. *Vutek, Inc.*, Case No. 4:05 CV 788 CDP; United States District Court Eastern District of Missouri, Eastern Division; Oct. 2, 2006.

United States District Court Eastern District of Missouri Eastern Division; Memorandum in Support of Vutek's Motion for Summary Judgment of Invalidity; *Leggett & Platt, Inc.* v. *Vutek, Inc.*, Case No. 4:05 CV 788 CDP; United States District Court Eastern District of Missouri, Eastern Division; Oct. 2, 2006.

United States District Court Eastern District of Missouri Eastern Division; L&P's Memorandum in Opposition to Vutek's Motion for Summary Judgment of Invalidity; *Leggett & Platt, Inc.* v. *Vutek, Inc.*, Case No. 4:05 CV 788 CDP; United States District Court Eastern District of Missouri, Eastern Division; Nov. 1, 2006.

United States District Court Eastern District of Missouri Eastern Division; Memorandum and Order; *Leggett & Platt, Inc.* v. *Vutek, Inc.*, Case No. 4:05 CV 788 CDP, Document 348; pp. 1-24; United States District Court Eastern District of Missouri, Eastern Division; Dec. 26, 2006.

* cited by examiner

METHOD AND APPARATUS FOR INK JET PRINTING ON RIGID PANELS

This application is a continuation of application Ser. No. 09/989,006, filed on Nov. 21, 2001 now U.S. Pat. No. 6,755,518, which is a continuation-in-part of PCT Application No. PCT/US01/27023 filed Aug. 30, 2001, the disclosure of which is hereby expressly incorporated by reference herein.

FIELD OF THE INVENTION

The present invention relates to printing onto rigid substrates, and to the printing onto textured, contoured or other three-dimensional substrates. The invention is particularly related to the printing onto such substrates as those having textile fabric surfaces or molded objects, rigid panels such as office partitions, automobile interior panels and other contoured objects, and to such printing using ink jet printing techniques.

BACKGROUND OF THE INVENTION

Applying ink to a substrate by ink jet printing requires a proper spacing between the ink jet nozzles and the surface of the substrate to which the printing is applied. Normally, this spacing must be set to within one or two millimeters to maintain effective printing by an ink jet process. If the distance from the nozzles to the surface being printed is too great, deviations from ideal parallel paths of the drops from different nozzles become magnified. Further, the longer the flight path of the drops from the printhead to the substrate, the more dependent the accuracy of the printing becomes on the relative speed between the printhead and the substrate. This dependency limits the rate of change in printhead-to-substrate velocity, including changes in direction. Also, the velocity of the drops moving from the printhead nozzles to the substrate declines with the distance traveled from the nozzles, and the paths of such drops become more greatly affected by air currents and other factors with increased nozzle to substrate distance. Additionally, droplet shape changes the farther the drop moves from the nozzle, which changes the effects of the drop on the substrate. Accordingly, variations in the distance from the printhead to the substrate can cause irregular effects on the printed image.

In addition to problems in jetting ink onto contoured surfaces, the curing of UV inks requires delivery of sufficient curing energy to the ink, which is often difficult to achieve where the surface is contoured.

Further, some substrates deform, even temporarily, when heated. Deformation caused by heat may be such that, for example, the material returns to its undeformed state when it cools. Nonetheless, even temporary deformation can adversely affect the print quality if it exists when ink is being jetted onto the substrate. Where spot curing of UV inks is employed, which is performed by exposing ink to UV immediately upon its contacting the substrate, UV that is accompanied by heat producing radiation can deform substrates such as foamboard while the ink jets are making single or multiple passes over the deformed print area.

For these reasons, ink jet printing has not been successful on contoured materials and other three-dimensional substrates, particularly when printing with UV curable inks.

SUMMARY OF THE INVENTION

An objective of the present invention is to provide for the ink jet printing onto substrates that tend to deform when heated. A particular objective of the present invention is to maintain desired printhead-to-substrate spacing when jetting ink onto rigid substrates, particularly with UV curable inks.

According to the principles of the present invention, printed images are applied to rigid substrates with printing elements that may be moveable relative to the plane of the substrate being printed. In certain embodiments, the invention provides a wide-substrate ink jet printing apparatus with printheads that move toward and away from the plane of a substrate to maintain a fixed distance between the nozzles of the printhead and the surface onto which the ink is being jetted. The variable distance over the plane of the substrate allows a controlled and uniform distance across which the ink is jetted.

According to the invention, the printing element may include an ink jet printhead set having a plurality of heads, typically four, each for dispensing one of a set of colors onto the substrate to form a multi-colored image. To maintain the constant distance or to otherwise control the distance, one or more sensors may be provided to measure the distance from the printhead or from the printhead carriage track to the point on the substrate on which ink is to be projected. Such sensors generate reference signals that are fed to a controller that controls a servo motor on the printhead carriage. The printhead may be moveably mounted to the carriage, for example, on a ball screw mechanism, and be moveable toward and away from the plane of the substrate by operation of the servo motor. Each printhead of the set may include four different color printheads that are separately moveable relative to a common printhead carriage, and are each connected to one of a set of four servo motors by which its position relative to the plane of the substrate is capable of control relative to the positions of the other printheads. The printheads of the set may be arranged side-by-side in the transverse direction on the carriage so that one head follows the other across the width of the substrate as the carriage scans transversely across the substrate.

Each printhead has, in the preferred embodiment, a plurality of ink jet nozzles thereon for dispensing a given color of ink in a corresponding plurality of dots, for example, 128 in number, that extend in a line transverse to the carriage, which is in a longitudinal direction perpendicular to the scan direction of the carriage. Two laser or optical sensors are provided on the carriage, one on each side of the heads, so that a distance measurement of the surface to the substrate can be taken ahead of the printheads when the heads are scanning in either direction. The controller records the contour of the substrate ahead of the printheads and varies the position of each printhead, toward and away from the substrate plane, as each printhead passes over the points at which the measurements were taken, so that each of the independently moveable heads follows the contour and maintains a fixed distance from the surface being printed. While it is preferred to adjust the position of the printhead or nozzle thereof relative to the substrate which is fixed on a printing machine frame, the substrate surface can alternatively be positioned relative to a printhead that is maintained at a fixed vertical position on the frame.

According to the preferred embodiment of the invention, UV ink is printed onto material and the cure of the ink is initiated by exposure to UV light radiated from UV curing lights mounted on the printhead carriage, one on each side of the printhead set. The lights are alternatively energized, depending on the direction of motion of the carriage across the substrate, so as to expose the printed surface immediately behind the heads. By so mounting the UV curing lights on the printhead carriage, the jetted ink can "spot cure" the ink, or to cure the ink immediately upon its contacting the substrate. Such spot curing "freezes the dots" in position and prevents their spreading on or wicking into or otherwise moving on the substrate. With certain substrates, conventional or broad spectrum UV curing lights include radiation that can heat the substrate. Such radiation includes infra-red radiation and radiation of such other wavelengths that tend to heat a particular substrate.

In the case of many rigid substrates, such as foamboard and several other of the more commonly used substrates, energy radiating from the UV light curing source onto the substrate heats the substrate enough to deform it. Such deformation can deform rapidly, with the surface of the substrate rising or rippling within seconds of exposure. Usually, this deposition is temporary in that the substrate blisters or swells when heated but returns to its original condition immediately upon cooling. Where the UV exposure is carried out downstream of the printhead carriage, usually no harm results.

In the case of spot curing, the UV exposure occurs close to the point of printing. Deformation of the substrate surface that occurs due to heat in spot curing can extend to the portion of the substrate that is still to be printed, thereby changing the printhead-to-substrate spacing and adversely affecting the quality of the ink jet printing operation.

The present invention provides the use of cold UV sources for spot curing of UV curable ink on heat sensitive rigid substrates. Heat caused deformation of the substrate in the region of the printing operation is prevented with the use of a cold UV source, Such a cold UV source can, for example, be a limited bandwidth UV source, to limit energy of wavelengths that are not effective to cure the ink from otherwise striking and heating the substrate. This can be carried out with selective bandwidth sources or with the use of filters to remove energy of undesired wavelengths. Alternatively, heat removal can be employed to remove the heat that is produced by the curing radiation. The cold UV source is useful for printing onto substrates that can deform, even temporarily, when heated, and is particularly useful where spot curing of the ink can otherwise result in the deformation of the material on which printing is still to take place.

Deformation at the printing site, even if temporary such that the material returns to its undeformed state when it cools, adversely affects the print quality because spot curing deforms the substrate as the ink jets are making single or multiple passes over the print area. This is particularly the case when printing onto foamboards that make up the largest application of printing onto rigid substrates. Such deformation of the board from heat during printing would force adjustment of the head height above the deformation zone. Higher head height usually results in poorer print quality. With a cold-UV spot-cure ink-jet system, the head-to-substrate distance can be minimized to maximize print quality.

In prior practice, spot curing has not been used to ink jet print onto rigid substrates, except as proposed by applicants. Cold UV is known for curing UV ink downstream of a printing station to prevent permanent deformation to or buring of the substrate. Temporary deformation that will disappear after the substrate cools has not been a problem in the prior art. Such deformation is likely to be a problem where slight raising or warping of the surface takes place as ink is being jetted onto the substrate, which can occur during spot curing.

When printing onto contoured material, the distance from the printheads to the substrate where the ink is to be deposited can be determined by measuring the distance from a sensor to the substrate ahead of the printheads and mapping the location of the surface. For bidirectional printheads that move transversely across the longitudinally advancing fabric, providing two distance measuring sensors, one on each of the opposite sides of the printheads, are provided to measure the distance to the contoured fabric surface when the printheads are moving in either direction. For some inks and for sufficiently rigid materials, a mechanical rolling sensor may be used, for example, by providing a pair of rollers, with one roller ahead of, and one head behind, the printhead so that the average distance between the two rollers and a reference point on the printhead can be used to control the distance of the printhead from the plane of the substrate. To achieve this, one or more printheads can be mounted to a carriage having the rollers on the ends thereof so that the mechanical link between the rollers moves the printhead relative to the plane of the substrate. In most cases, a non-contact sensor, such as a laser or photo eye sensor, is preferred in lieu of each roller. The outputs of two sensors on opposite sides of the printheads can be communicated to a processor, to measure the distance from the heads to the fabric ahead of the bidirectional heads, to drive a servo motor connected to the printhead to raise and lower the head relative to the substrate plane so that the printheads move parallel to the contoured surface and jet ink onto the fabric across a fixed distance.

These and other objects of the present invention will be more readily apparent from the following detailed description of the preferred embodiments of the invention.

DETAILED DESCRIPTION OF THE PREFERRED EMBODIMENT

Ink jet printing onto large rigid substrates is described in the commonly assigned and copending U.S. patent applications Ser. Nos. 09/650,596, filed Aug. 30, 2000, and 09/822,795, filed Mar. 30, 2001, hereby expressly incorporated by reference herein. Ink jet printing onto large substrates, particularly textiles, is described in the commonly assigned and copending U.S. patent applications Ser. No. 09/390,571, filed Sep. 3, 1999, Ser. No. 09/823,268, filed Mar. 30, 2001 and Ser. No. 09/824,517, filed Apr. 2, 2001, and International Application Serial No. PCT/US00/24226, filed Sep. 1, 2000, each hereby expressly incorporated by reference herein.

Figure 1:
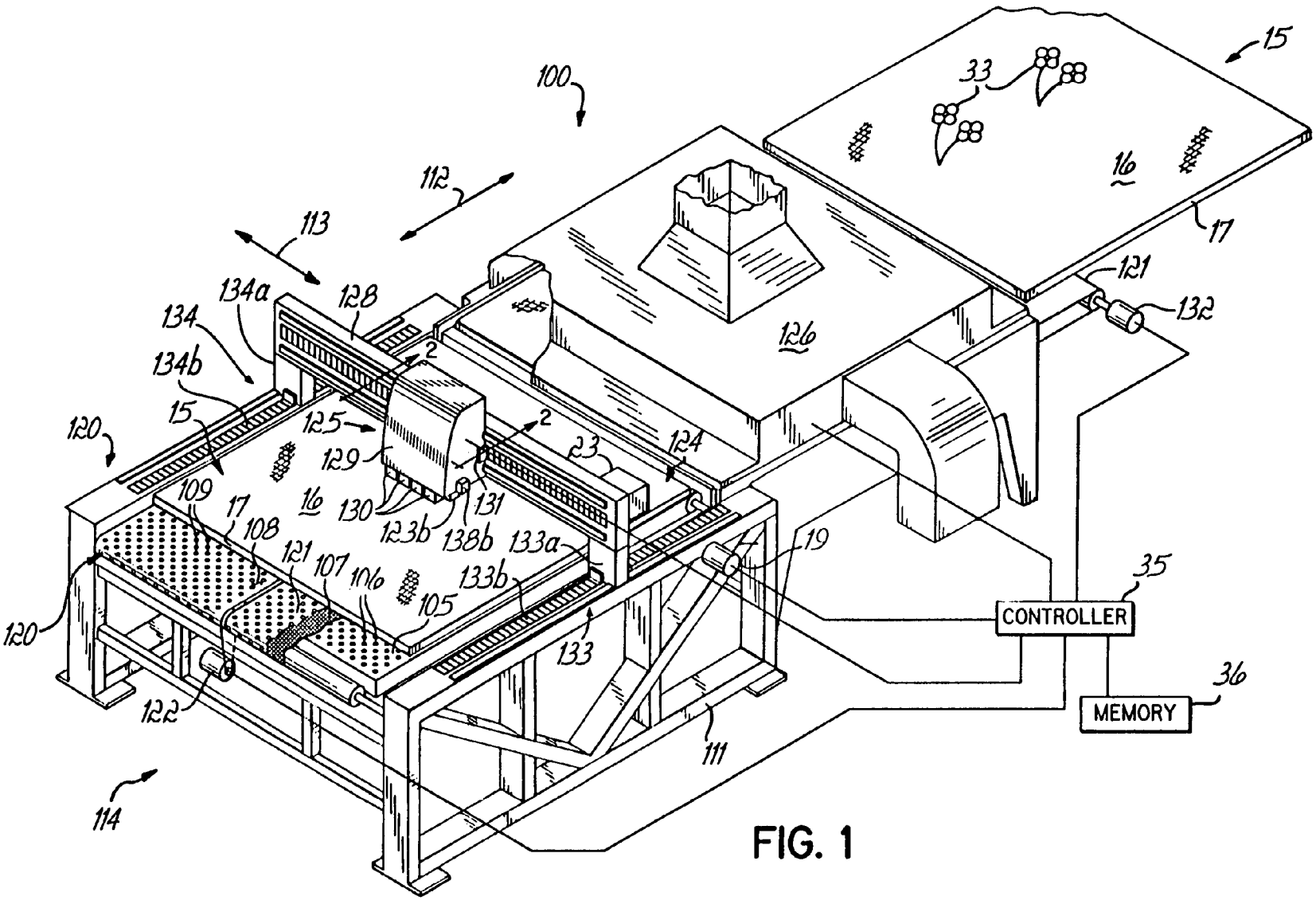
FIG. 1 is a perspective view of one embodiment of an apparatus embodying principles of the present invention.

FIG. 1 illustrates an ink jet printing machine 100 for printing onto wide rigid substrates. The machine 100 includes a stationary frame 111 with a longitudinal extent represented by an arrow 112 and a transverse extent represented by an arrow 113. The machine 100 has a front end 114 into which the rigid panel 15 may be loaded onto a belt 121 of a conveyor system 120 having one or more flights which carry the panel 15 longitudinally through the machine 100. The belt 121 of the conveyor system 120 extends across the width of the frame 111 and rests on a smooth stainless steel vacuum table 105, which has therein an array of upwardly facing vacuum holes 106 which communicate with the underside of the belt 121. The belt 121 is sufficiently porous that the vacuum from the table 105 communicates through the belt 121 to the underside of the rigid panel 15 to assist gravity in holding the panel 15 in place against the top side of the belt 121. Preferably, the belt 121 has a high friction rubber-like surface 108 to help prevent a horizontal sliding of a panel resting on it, through which an array of holes 109 or open mesh is provided to facilitate communication of the vacuum from the table 105 to the substrate.

The top surface of the belt 121 of the conveyor 120 is such that it provides sufficient friction between it and the underside of the panel 15 to keep the panel 15 from sliding horizontally on the conveyor 120. The conveyor 120 is further sufficiently non-elastic so that it can be precisely advanced. To this end, the belt 121 has a non-elastic open weave backing 107 to provide dimensional stability to the belt while allowing the vacuum to be communicated between the holes 106 of the table 105 and the holes 109 or open mesh in the surface of the belt 121.

The forward motion of the panel 15 on the frame 111 is precisely controllable by indexing of the belt 121 by control of a servo drive motor 122 with signals from the controller 35. The belt 121 thereby retains the panels 15 in a precisely known longitudinal position on the belt 121 so as to carry the panels 15 through the longitudinal extent of the machine 100. Such indexing of the belt 121 should be controllable to an accuracy of about 0.0005 inches where used to move the panel 15 relative to a printhead on a fixed bridge (which embodiment is not shown). In the machine 100 illustrated in FIG. 1, the longitudinal movement of the belt 121 of the conveyor 120 is controlled by the conveyor drive 122 to move the panel into printing position and then to advance it downstream after it is printed. One or more additional separately controllable drives 132 may be provided to control the downstream flights, if any, of the conveyor 120.

Along the length of travel of the conveyor 120 may be provided two or more stations, including an ink jet printing station 125 and one or more curing or drying stations, which may include UV light curing stations 124 and/or a heating station 126. The printing station 125 includes a bridge 128. Where the belt 121 is operable to precisely index the panel 15 relative to the bridge 128, the bridge may be fixed to the frame 111 and extend transversely across it. A printhead carriage 129 is transversely moveable across the bridge 128 and has one or more sets 130 of ink jet printing heads thereon. The carriage 129 is preferably fixed to the armature of a linear servo motor 131 which has a linear array of stator magnets extending transversely across the bridge 128, so that the carriage 129 is transversely moveable across the bridge 128 by positioning and drive control signals sent to the servo 131 by the controller 35, described above.

In the illustrated embodiment, the bridge 128 is mounted to the moveable armatures 133*a*, 134*a* that ride on longitudinal tracks 133*b*, 134*b* of linear servo motors 133, 134 at each side of the conveyor 120. Once a panel 15 is positioned under the bridge 128 by movement of the belt 121, the bridge 128 is indexed in the longitudinal direction as transverse bands of an image are printed in successive scans of printheads 130, described below. This indexing should be as accurate as needed to insure that the scans register one with another and can be interlaced, as required, to produce the desired print quality and resolution. Such accuracy is preferred to be about 0.0005 inches. Lower resolution, and thus less accuracy, is acceptable for printing on textile surfaces rather than on smoother surfaces such as vinyl.

Figure 2:
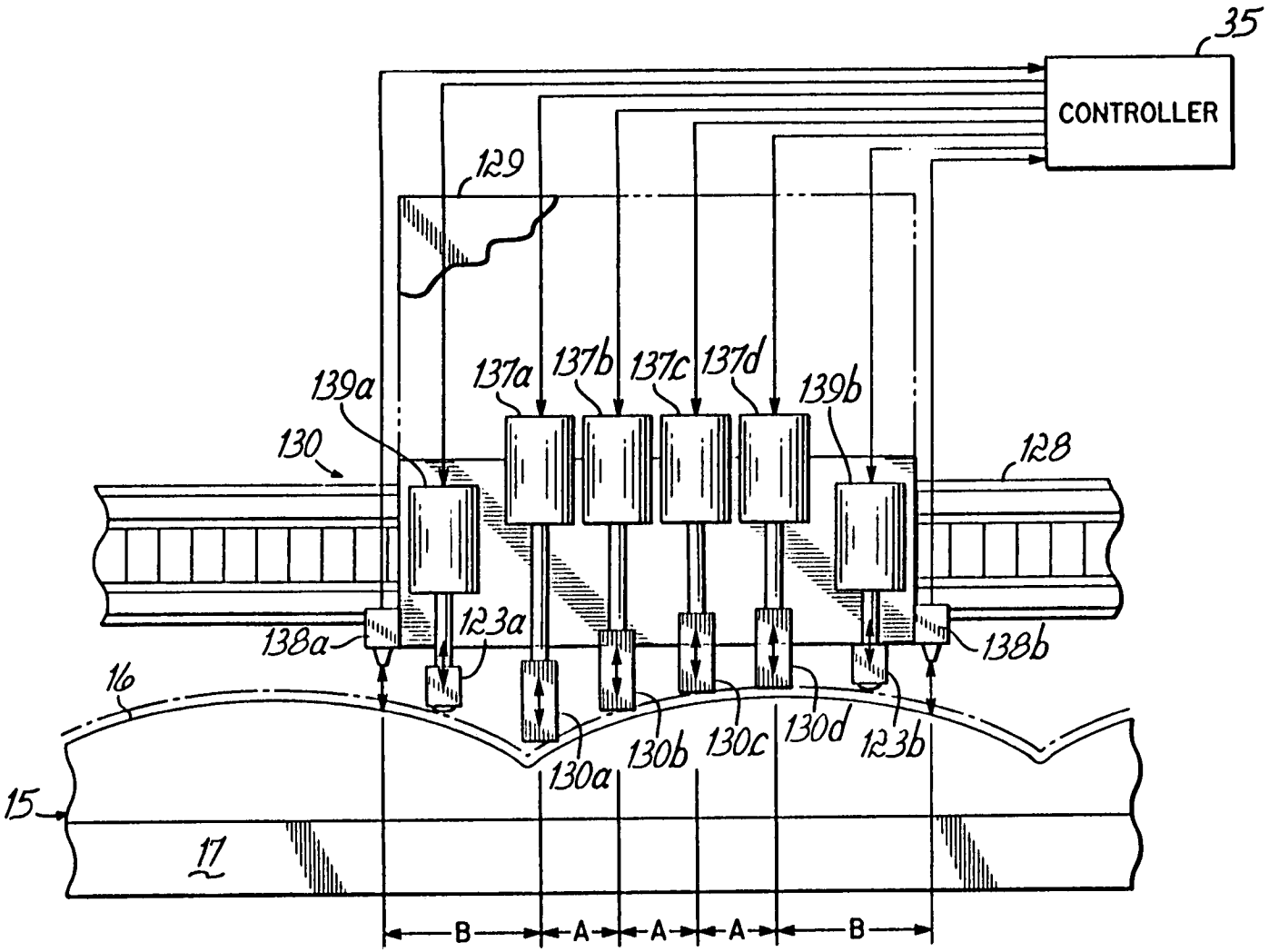
FIG. 2 is a partial cross-sectional view along line 2-2 of FIG. 1 showing structure for maintaining printhead-to-substrate distance on a contoured substrate.

FIG. 2 illustrates a set 130 of four ink jet printing heads 130*a*-130*d* configured to respectively apply the four colors of a CMYK color set. The ink jet printing heads 130*a-d* each include a linear array of one hundred twenty-eight (128) ink jet nozzles that extend in the longitudinal direction relative to the frame 111 and in a line perpendicular to the direction of travel of the carriage 129 on the bridge 128. The nozzles of each of the heads 130 are configured and controlled to simultaneously but selectively jet UV ink of one of the CMYK colors side-by-side across the substrate 15, and to do so in a series of cycles as the nozzles scan the substrate 15. The heads 130*a-d* of a set are arranged side-by-side to print consecutively across the same area of the substrate 15 as the carriage 129 moves across the bridge 128, each depositing one of the four colors sequentially on each dot position across the substrate 15.

Each of the heads 130*a-d* is moveably mounted to the carriage to individually move vertically or perpendicular to the plane of the substrate 15. The distance of each head 130*a-d* from the plane of the substrate 15 is controlled by a respective one of a set of servos 137*a-d* mounted to the carriage 129 to follow one behind the other over the same contour of the substrate 15. The servos 137*a-d* are responsive to signals from the controller 35 which control the positions of the heads 130*a-d* to maintain each a controlled distance from the surface of the substrate 15 where the surface 16 of the substrate 15 is contoured.

Usually, it is desirable to maintain the heads a fixed distance from the surface 16 on which they are to print. This is achieved by providing optical sensors 138*a*, 138*b* on the opposite transverse sides of the carriage 129. The printhead set 130 is bidirectional and prints whether moving to the right or to the left. As the printhead carriage 129 moves on the bridge 128, the leading one of the sensors 138*a* or 138*b* measures the distance from the sensor 138 and the surface 16 of the substrate 15 at a point directly in line with, typically directly below, the sensor 138. This measurement is communicated to the controller 35, which records the measured distance and the coordinates on the surface 16 of the substrate 15 at which the measurement was taken. These coordinates need only include the transverse position on the substrate 15 where the information is to be used in the same pass or scan of the carriage in which the measurement was taken. However, the controller 35 may also record the longitudinal coordinate by taking into account the position of the panel 15 on the frame 111 relative to the bridge 128.

In response to the measurements, the controller 35 controls the servos 137 to vertically position the each of the heads 130 to a predetermined distance from the contoured surface 16 of the substrate 15 as the respective head arrives at the transverse coordinate on the substrate 15 at which each measurement was taken. As a result, the nearest of the heads 130 to the leading sensor 138, which are spaced a distance B from the sensor 138, follows the contour of the fabric at a delay of V/B seconds after a given measurement was taken, where V is the velocity of the carriage 129 on the bridge 128. Similarly, the heads 130 are spaced apart a distance A and will each sequentially follow the same contour as the first head at V/A seconds after the preceding head.

The extent of the heads 130 in the longitudinal direction determines the accuracy with which the heads can follow the contours of the substrate 15. Greater accuracy can be maintained, and more variable contours can be followed, by using narrower heads, for example, of 64 or 32 jets per head in the longitudinal direction. Accordingly, multiple sets of heads 130 can be arranged in a rectangular or other array on the carriage 129, with heads of the different sets being arranged side-by-side across the carriage 129 in the longitudinal direction of the substrate 15 and frame 111. For example, two sets of heads having 64 jets per head each or four sets of heads having 32 jets per head each will produce the same 128 dot wide scan, but with greater ability to maintain spacing from head to substrate where the contours vary in the longitudinal direction on the substrate 15.

Printing on rigid panels, even where the surface is not textured or contoured, can benefit from the sensing and adjustment of the distance from print nozzle to surface of the panel since the rigid frame of the panel and the thickness of the panel when supported on the frame of a printing apparatus makes the position of the upper surface of the panel unpredictable.

Where UV curable ink is used, the UV curing station 124 is provided as illustrated in FIG. 1. It may include a UV curing head 23 transversely moveable independently of the printheads 130 across the downstream side of the bridge 128 or otherwise located downstream of the printing station 125, and/or may include UV light curing heads 123*a* and 123*b* mounted on the carriage 129.

Where employed to separately move across the substrate, the curing head 23 is preferably intelligently controlled by the controller 35 to selectively operate and quickly move across areas having no printing and to scan only the printed images with UV light at a rate sufficiently slow to UV cure the ink, thereby avoiding wasting time and UV energy scanning unprinted areas. If the head 23 is included in the printing station 25 and is coupled to move with the printheads 30, UV curing light can be used in synchronism with the dispensing of the ink immediately following the dispensing of the ink.

Where UV curing heads are employed on the carriage 129, as the carriage 129 moves transversely on the bridge 128, only the curing head 123*a*, 123*b* that trails the printheads 130 is operated so that the UV light exposes ink after its deposition onto the substrate 15. Such carriage mounting of the curing heads 123*a*, 123*b* enables the freezing of the dots of ink where they are deposited, reducing drop spread and wicking of the ink. The curing heads 123*a*, 123*b* may also be moveable toward and away from the plane of the substrate 15 in the same manner as the printheads 130*a-d*, controllable by servos 139*a*, 139*b*, respectively, to maintain their spacing from the surface 16, as illustrated in FIG. 2.

Effective curing of UV ink requires that the UV light be either parallel beam light, have a long depth of field, or be more precisely focused on the surface bearing the ink. Precise focus is more energy efficient, in which case, moving the UV heads 123*a*, 123*b* to maintain a constant spacing from the surface 16 maintains the focus of the curing UV light. UV light curing heads are typically configured to sharply focus a narrow, longitudinally extending beam of UV light onto the printed surface. Therefore, instead of physically moving the UV light curing heads or sources 123*a*, 123*b*, the focal lengths of the light curing heads 123*a*, 123*b* may be varied to follow the contours of the substrate 15. The light curing head 123, where used, may similarly be configured to move perpendicular to the surface 16 of the substrate 15.

Further, in accordance with the preferred embodiment of the invention, the UV curing heads, particularly when mounted on the carriage, are cold-UV light, which, through the use of filters or narrow bandwidth radiation, avoid heating a substrate 15. This is particularly useful where the apparatus 100 is to be used for printing onto heat sensitive substrates such as foamboard. Where carriage mounted UV curing heads 123*a*, 123*b* are used and the freezing of the dots at the point of jetting is desired, deforming the substrate at the location where the ink drops are being deposited would degrade the printed image. Such cold-UV curing light systems use cold mirrors, infrared cut filters, and water cooled UV curing to keep the temperature of the substrate low, avoiding substrate deformation.

Figure 4:
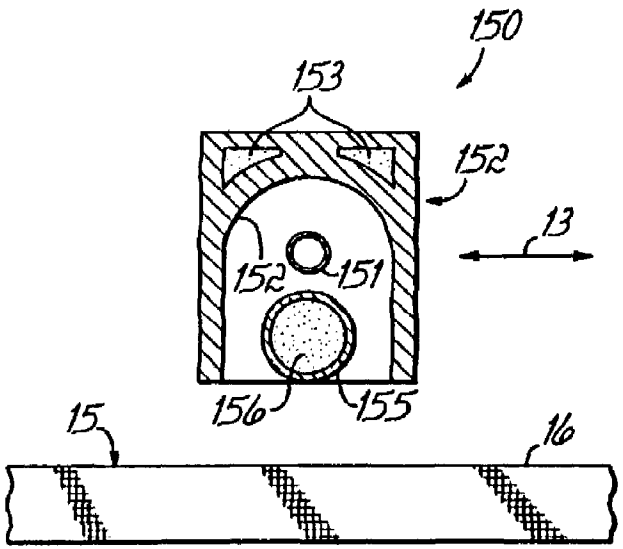
FIG. 4 is a cross-sectional view through the UV curing head of the printhead carriage of FIG. 3.
Figure 3:
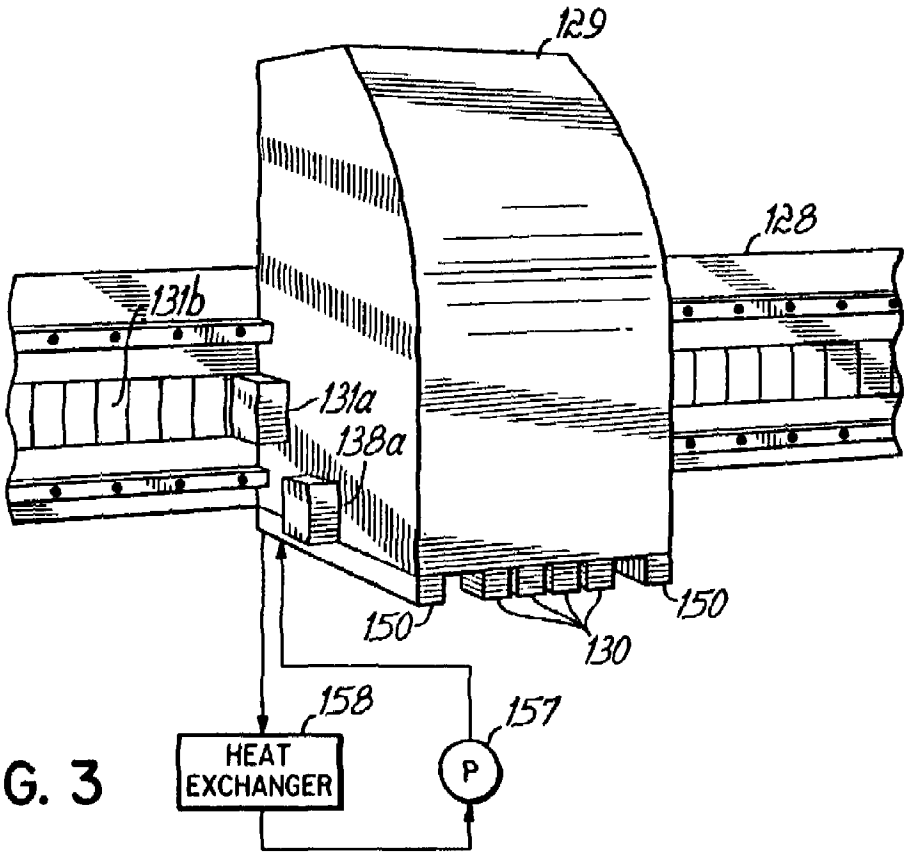
FIG. 3 is a perspective view of the printhead carriage of the apparatus of FIG. 1.

FIG. 3 illustrates the details of an arrangement of the carriage 129 on which cold UV curing heads 150 are used in place of the heads 123*a*, 123*b* described above. A head of the type 150 may also be used in place of the separate curing head 123 described above. Such UV heads 150 in the embodiment illustrated are fixed, rather than vertically moveable, and emit parallel UV light rather than focused light. The heads 150 each include a ten inch linear bulb 151 approximately one inch in diameter located at the focal point of a downwardly facing ten inch linear reflector 152 having a lower surface 153 having a generally parabolic cross section as illustrated in FIG. 4. The reflector 152 is formed of extruded aluminum and has a pair of cooling fluid return channels 153 formed therein that run the length thereof. Extending the length of the head 150 and positioned directly below the bulb 151 is a hollow UV transparent tube 155 which may be formed of a temperature and radiation tolerant material, for example, quartz. The tube 155 has a fluid 156, for example, de-ionized water, flowing therein. The tube is connected in a circuit with the cooling channels 153 and a recirculating pump 157 so that the cooling fluid 156 flows through the tube 155, where it absorbs approximately 80-85% of the infrared energy passing therethough, while only absorbing about 6-8% of the UV light, and then through the channels 153 further pick up heat from the wall of the reflector 152. Before flowing to the pump 157, the fluid from the channels 153 flows through a heat exchanger 158 where it is cooled. The bulbs 151 consume approximately 125 to 200 watts per linear inch, but may be operated at different power levels. Assemblies suitable for the heads 150 are available from Printing Research, Inc., Dallas, Tex., www-.superblue.net. In operation, UV light is emitted from the bulbs 151 along with radiant energy of other wavelengths, such as infrared light, that would result in the heating of the substrate 15. Such radiant energy of these other wavelengths is, however, mostly absorbed in the fluid 156 and removed before impinging on the substrate 15. As a result, no thermal distortion, even of a temporary nature, occurs at the surface 16 of the substrate 15.

The heat curing or drying station 126 may be fixed to the frame 111 downstream of the printing station 125 and the UV light curing station, if any, may be located off-line. Such a drying station 126 may be used to dry solvent based inks with heated air, radiation or other heating techniques. It may also be used to further cure or dry UV inks.

The heat curing or drying station 26 may be fixed to the frame 11 downstream of the UV light curing station or may be located off-line. With 97% UV cure, the ink will be sufficiently colorfast so as to permit the drying station to be off-line. When on-line, the drying station should extend sufficiently along the length of fabric to adequately cure the printed ink at the rate that the fabric is printed. When located off-line, the heat curing station can operate at a different rate than the rate of printing. Heat cure at the oven or drying station 26 maintains the ink on the fabric at about 300° F. for up to three minutes. Heating of from 30 seconds to three minutes is the anticipated advantageous range. Heating by forced hot air is preferred, although other heat sources, such as infrared heaters, can be used as long as they adequately penetrate the fabric to the depth of the ink.

The above description is representative of certain preferred embodiments of the invention. Those skilled in the art will appreciate that various changes and additions may be made to the embodiments described above without departing from the principles of the present invention.

The invention claimed is:

1. A method of ink jet printing UV curable ink on a substrate that may be formed of a heat sensitive rigid or other material, the method comprising:

moving a printhead carriage having an ink jet printhead thereon approximately parallel to a substrate;

jetting ink from the printhead across a predetermined distance onto the surface of a substrate;

providing at least one cold UV lamp on the carriage oriented to direct UV energy onto the surface of the substrate sufficiently close to where ink is being jetted onto the surface so as to substantially cure dots of the jetted ink on the surface; and the cold UV lamp being effective to impinge sufficient UV energy on the jetted ink to substantially cure the jetted ink without impinging sufficient radiation of other wavelengths that would heat the substrate so as to deform it to materially alter the predetermined distance between the substrate and the printhead while the substrate is under the printhead; and applying a vacuum to the substrate to help maintain the predetermined distance between the substrate and the printhead.

2. An ink jet printing apparatus for printing with UV curable ink on a substantially rigid substrate having a tendency to deform toward the printhead when heated, the apparatus comprising:

a substrate support defining a substrate supporting plane;

a vacuum source to apply a vacuum to the substrate to help maintain a distance between the substrate and a printhead;

a printhead track extending parallel to the plane having a printhead carriage moveable thereon;

at least one ink jet printhead on the carriage; and at least one cold UV lamp on the carriage sufficiently close to the ink jet printhead to substantially cure ink in position on the substrate when jetted thereon from the printhead;

the UV lamp being configured to emit sufficient UV energy to substantially cure the ink jetted onto the substrate without heating so as to thermally deform the substrate under the printhead.

3. The apparatus of claim 2 further comprising:

at least two cold UV curing lamps, one positioned on the carriage at each side of the printheads so that one leads the printheads and one trails the printheads as the carriage moves on in either of two opposite directions on the track; and the controller is operable to activate at least one of the UV curing head's lamps to expose the ink jetted by the printheads on the surface of the substrate.

4. A method of dispensing UV curable ink from a printhead onto a substantially rigid substrate formed of a material that has a tendency to deform at least temporarily if exposed to radiant energy, the method comprising:

moving a printhead with a cold UV lamp approximately parallel to a substrate at a printing station;

dispensing ink from the printhead onto a surface of the substrate;

applying a vacuum to the substrate to help hold the substrate in place; and directing UV radiation from the cold UV lamp onto the surface of the substrate to substantially cure the ink without impinging radiation that would materially deform the substrate while the substrate is at the printing station so as to materially alter the distance between the substrate and the printhead.

5. An ink jet printing apparatus for printing upon a substrate, the ink jet printing apparatus comprising:

a vacuum table configured to hold a substrate via a vacuum;

a printhead carriage;

a printhead coupled to and movable with the printhead carriage to different positions with respect to the substrate; and a cold UV lamp coupled to and movable with the printhead carriage and configured to direct an amount of UV energy toward the substrate, the amount of UV energy sufficient to substantially cure ink dispensed from the printhead upon the substrate, but insufficient to substantially thermally deform the substrate.

6. The apparatus of claim 5 wherein:

the substrate is foamboard.

7. The apparatus of claim 5 wherein the cold UV lamp includes a limited bandwidth UV source.

8. The apparatus of claim 5 wherein the cold UV lamp comprises:

at least one UV lamp;

a reflector having a surface configured to direct UV light onto the substrate from behind the at least one UV lamp; and a fluid cooling system coupled to the reflector.

9. The apparatus of claim 5 wherein the cold UV lamp consumes power of at least approximately 125 watts per linear inch.

10. The apparatus of claim 5 wherein the cold UV lamp is capable of being operated at a power consumption of at least 200 watts per linear inch.

11. The apparatus of claim 5 wherein the cold UV lamp comprises:

at least one lamp fixed relative to the printhead that emits UV light;

a reflector having a surface configured to direct UV light onto the substrate from behind the at least one lamp; and a fluid cooling system coupled to the reflector.

12. An ink jet printing apparatus for printing upon a substrate, the ink jet printing apparatus comprising:

a printhead carriage;

a printhead coupled to and movable with the printhead carriage to different positions with respect to the substrate; and a cold UV curing head configured to direct an amount of UV energy toward the substrate, the amount of UV energy sufficient to at least substantially cure ink dispensed from the printhead upon the substrate, but insufficient to substantially thermally deform the substrate, the cold UV curing head including at least one lamp fixed relative to the printhead that emits UV light;

a reflector having a surface configured to direct UV light onto the substrate from behind the at least one lamp;

a fluid cooling system coupled to the reflector; and a hollow tube, substantially transparent to UV radiation, substantially absorbent of infrared radiation, and formed of a temperature and radiation tolerant material, the tube extending the length of the head and being positioned between the at least one lamp and the substrate.

13. The apparatus of claim 12 wherein the cold UV curing head further comprises:

a second fluid cooling system coupled to the tube to remove heat energy from infrared radiation by the tube.

14. An ink jet printing apparatus for printing upon a deformable substrate, the apparatus comprising:

a printhead carriage;

a printhead coupled to and movable with the printhead carriage to different positions with respect to the deformable substrate and configured to jet ink onto the deformable substrate;

a vacuum table configured to hold the substrate via a vacuum; and a cold UV lamp on the printhead carriage configured to direct UV energy onto the deformable substrate so as to substantially cure the jetted ink without directing energy that would substantially deform the substrate;

the cold UV lamp including, a reflector with a surface configured to direct UV light from the lamp onto the deformable substrate, and a cooling system configured to take heat away from the lamp.

15. The apparatus of claim 14 wherein the cold UV curing head comprises:

at least two lamps, one on each side of the printhead, each having a reflector with a surface configured to direct UV light onto the deformable substrate from behind each lamp; and the apparatus further comprising a cooling system configured to take heat away from each reflector.

16. The apparatus of claim 14 wherein the vacuum table has vacuum ports therein and a vacuum system coupled to the ports.

17. The apparatus of claim 14 wherein the substrate is foamboard.

18. An ink jet printing apparatus for printing upon a deformable substrate, the apparatus comprising:

a printhead carriage;

a printhead coupled to and movable with the printhead carriage to different positions with respect to the deformable substrate;

a substrate support table configured to support the deformable substrate for printing thereon by the printhead; and a cold UV curing head on the carriage configured to direct UV energy toward the substrate;

the cold UV curing head including at least one lamp having a power consumption of at least approximately 125 watts per linear inch;

a hollow tube, substantially transparent to UV radiation, substantially absorbent of infrared radiation, and formed of a temperature and radiation tolerant material, the tube extending the length of the head and being positioned between the at least one lamp and the substrate; and a fluid cooling system coupled to the tube to remove heat energy from infrared radiation by the tube.

19. A method of ink jet printing with UV curable ink onto a rigid substrate held by a vacuum to a support surface, the method comprising:

moving a printhead carriage having an inkjet printhead and cold UV lamp thereon substantially parallel to the substrate;

applying a vacuum to the substrate;

jetting ink from the printhead onto the substrate while the substrate is held by the vacuum; and directing UV energy from the cold UV lamp onto the substrate while the substrate is held by the vacuum to substantially cure the ink without impinging sufficient energy that would deform the substrate under the printhead so as to substantially change the distance between the printhead and the substrate.

20. An ink jet printing apparatus for printing upon a rigid substrate, the ink jet printing apparatus comprising:

a printhead carriage;

a printhead coupled to and movable with the printhead carriage to different positions with respect to the substrate;

a vacuum table configured to hold a substrate in place via a vacuum and help maintain a distance between the substrate and the printhead; and a cold UV lamp coupled to and movable with the printhead carriage and configured to direct energy onto the surface of the substrate so as to substantially cure the jetted ink without impinging sufficient energy that would deform the substrate under the printhead so as to substantially alter the distance between the substrate and the printhead.

21. An ink jet printer for printing UV curable ink on a heat-sensitive substrate, the apparatus comprising:

a printhead carriage;

a printhead coupled to and moveable with the printhead carriage; at least one cold UV lamp coupled to and moveable with the printhead carriage, the UV lamp having one or more filters configured to prevent at least a portion of undesired energy emitted from the UV lamp from contacting the substrate;

a vacuum table for assisting in holding the substrate down and in place; and a cooling system to remove heat generated by the UV lamp, wherein the printer is configured to substantially cure ink while maintaining a distance between the substrate and the printhead by emitting sufficient UV energy to substantially cure the ink dispersed onto the substrate, and filtering undesired energy emitted by the UV lamp.

* * * * *

UNITED STATES PATENT AND TRADEMARK OFFICE

CERTIFICATE OF CORRECTION

PATENT NO. : 7,290,874 B2
APPLICATION NO. : 10/827097
DATED : November 6, 2007
INVENTOR(S) : Richard N. Codos It is certified that error appears in the above-identified patent and that said Letters Patent is hereby corrected as shown below:

On The Title Page Item (56) References Cited:

DELETE the following duplicate reference under OTHER PUBLICATIONS:

Frank Romano; Supplemental Expert Report of Frank Romano; Leggett & Platt, Inc. v. Vutek, Inc., Case No. 4:05 CV 788, United States District Court Eastern District of Missouri, Eastern Division; Jun. 9, 2006.

ADD the following missing reference under OTHER PUBLICATIONS:

Gerald J. Mossinghoff; Expert Report of the Honorable Gerald J. Mossinghoff; Leggett & Platt, Inc. v. Vutek, Inc., Case No. 4:05 CV 788, United States District Court Eastern District of Missouri, Eastern Division; 3 June 2006.

Signed and Sealed this

Twenty Second Day of April, 2008

JON W. DUDAS
*Director of the United States Patent and Trademark Office*